US010677477B2

(12) United States Patent
Gotou et al.

(10) Patent No.: US 10,677,477 B2
(45) Date of Patent: Jun. 9, 2020

(54) SOUNDPROOF COVER OF COMPRESSOR FOR AIR CONDITIONER

(71) Applicants: DAIKIN INDUSTRIES, LTD., Osaka-Shi (JP); PARKER CORPORATION, Tokyo (JP)

(72) Inventors: Takashi Gotou, Sakai (JP); Katsutoshi Sakurai, Sakai (JP); Kenichi Maegaito, Sakai (JP); Keisuke Ono, Tokyo (JP); Manabu Satou, Tokyo (JP)

(73) Assignees: DAIKIN INDUSTRIES, LTD., Osaka-shi (JP); PARKER CORPORATION, Tokyo (JP)

( * ) Notice: Subject to any disclaimer, the term of this patent is extended or adjusted under 35 U.S.C. 154(b) by 13 days.

(21) Appl. No.: 15/564,529

(22) PCT Filed: Apr. 19, 2016

(86) PCT No.: PCT/JP2016/062374
§ 371 (c)(1),
(2) Date: Oct. 5, 2017

(87) PCT Pub. No.: WO2016/175087
PCT Pub. Date: Nov. 3, 2016

(65) Prior Publication Data

US 2018/0080666 A1 Mar. 22, 2018

(30) Foreign Application Priority Data

Apr. 28, 2015 (JP) ..... 2015-091728

(51) Int. Cl.

| | |
|---|---|
| ***F24F 1/12*** | (2011.01) |
| ***F04B 39/00*** | (2006.01) |
| ***G10K 11/168*** | (2006.01) |

(52) U.S. Cl.
CPC ..... *F24F 1/12* (2013.01); *F04B 39/0033* (2013.01); *G10K 11/168* (2013.01)

(58) Field of Classification Search
CPC ..... F24F 1/12; G10K 11/168; F28D 1/05391; F25B 45/00; F25B 2600/2523; F25B 2400/16

(Continued)

(56) References Cited

U.S. PATENT DOCUMENTS 2,236,111 A * 3/1941 Philipp ..... F25D 23/003 417/201
2,701,618 A * 2/1955 Montgomery ..... E04H 1/1238 178/42

(Continued)

FOREIGN PATENT DOCUMENTS

CN 201672645 U 12/2010
CN 202271594 U 6/2012

(Continued)

OTHER PUBLICATIONS

International Search Report for International Application No. PCT/JP2016/062374 dated Aug. 2, 2016.

(Continued)

*Primary Examiner* — Ana M Vazquez
(74) *Attorney, Agent, or Firm* — Kratz, Quintos & Hanson, LLP

(57) ABSTRACT

A soundproof cover of a compressor for an air conditioner includes a sound-insulating material body portion (11) that is a rubber or thermoplastic-elastomer molded product with sound-insulating properties having a shape corresponding to an outer shape of a compressor body portion including a compressor leg portion positioned on a lower end side, having a folded portion (12) extending along a height direction of the compressor body portion and covering the (Continued)

compressor body portion by being folded through the folded portion (12), a sound-insulating material head portion (21) that is a rubber or thermoplastic-elastomer molded product with sound-insulating properties having a shape corresponding to an outer shape of a compressor head portion positioned on an upper end side of the compressor body portion and a sound absorbing material provided at least inside the sound-insulating material body portion (11).

11 Claims, 17 Drawing Sheets

(58) Field of Classification Search
USPC ..... 62/296
See application file for complete search history.

(56) References Cited

U.S. PATENT DOCUMENTS 4,991,406 A * 2/1991 Fujii ..... F24F 1/56 62/259.1
5,274,200 A 12/1993 Das
5,588,810 A * 12/1996 DiFlora ..... F04B 39/0033 181/202
7,357,219 B2 * 4/2008 Mafi ..... F24F 1/12 181/200
7,398,855 B2 * 7/2008 Seel ..... F01C 21/10 181/200
2013/0156614 A1 * 6/2013 Bonifas ..... G10K 11/16 417/313

FOREIGN PATENT DOCUMENTS

| | | | |
|---|---|---|---|
| JP | H01-159476 | A | 6/1989 |
| JP | H06-156082 | A | 6/1994 |
| JP | H08-61234 | A | 3/1996 |
| JP | H09-109957 | A | 4/1997 |
| JP | 2000-199482 | A | 7/2000 |
| JP | 2006242543 | A | 9/2006 |
| JP | 201368386 | A | 4/2013 |
| JP | 2015-075038 | A | 4/2015 |

OTHER PUBLICATIONS

Office Action of corresponding Chinese Patent Application No. CN201680021396.5 dated Oct. 9, 2018 (9 sheets) (Japanese language translation 9 sheets).
Extended European Search Report for corresponding European Patent Application No. EP16786364.6 dated Nov. 2, 2018 (9 sheets).

* cited by examiner

SOUNDPROOF COVER OF COMPRESSOR FOR AIR CONDITIONER

TECHNICAL FIELD

The present invention relates to a soundproof cover of a compressor for an air conditioner provided in an outdoor unit for the air conditioner.

BACKGROUND ART

In a compressor housed inside, for example, an outdoor unit of an air conditioner, various types of soundproof means are provided for the purpose of suppressing leakage of operating noise generated by the compressor to the outside in related art. For example, Patent Literature 1 discloses that a mold-processed felt material is attached to an outer surface of a compressor of an outdoor unit and an aluminum plate is further bonded to an outer surface of the felt material to be used as a soundproofing material.

CITATION LIST

Patent Literature

PTL 1: JP-A-2011-179709

SUMMARY OF INVENTION

Technical Problem

However, as the soundproofing material disclosed in Patent Literature 1 uses the aluminum plate which is a hard material, solid-borne sound may be generated when the material interferes with peripheral parts due to vibration occurring at the time of operation of the compressor. Accordingly, it is necessary to provide another cushioning material when the soundproofing material disclosed in Patent Literature 1 is actually used.

The present invention has been made in view of the above circumstances, and an object thereof is to provide a soundproof cover of a compressor for an air conditioner having manufacturability and workability while possessing excellent soundproofing performance.

Solution to Problem

A soundproof cover of a compressor for an air conditioner according to the present invention includes a sound-insulating material body portion that is a rubber or thermoplastic-elastomer molded product with sound-insulating properties having a shape corresponding to an outer shape of a compressor body portion including a compressor leg portion positioned on a lower end side, having a folded portion extending along a height direction of the compressor body portion and covering the compressor body portion by being folded through the folded portion, a sound-insulating material head portion that is a rubber or thermoplastic-elastomer molded product with sound-insulating properties having a shape corresponding to an outer shape of a compressor head portion positioned on an upper end side of the compressor body portion and a sound absorbing material provided at least inside the sound-insulating material body portion.

Advantageous Effects of Invention

In the soundproof cover of the compressor for the air conditioner according to the present invention is capable of possessing manufacturability and workability while possessing excellent soundproofing performance.

DESCRIPTION OF EMBODIMENTS

A soundproof cover of a compressor for an air conditioner according to the present invention will be explained with reference to the attached drawings.

Figure 1:
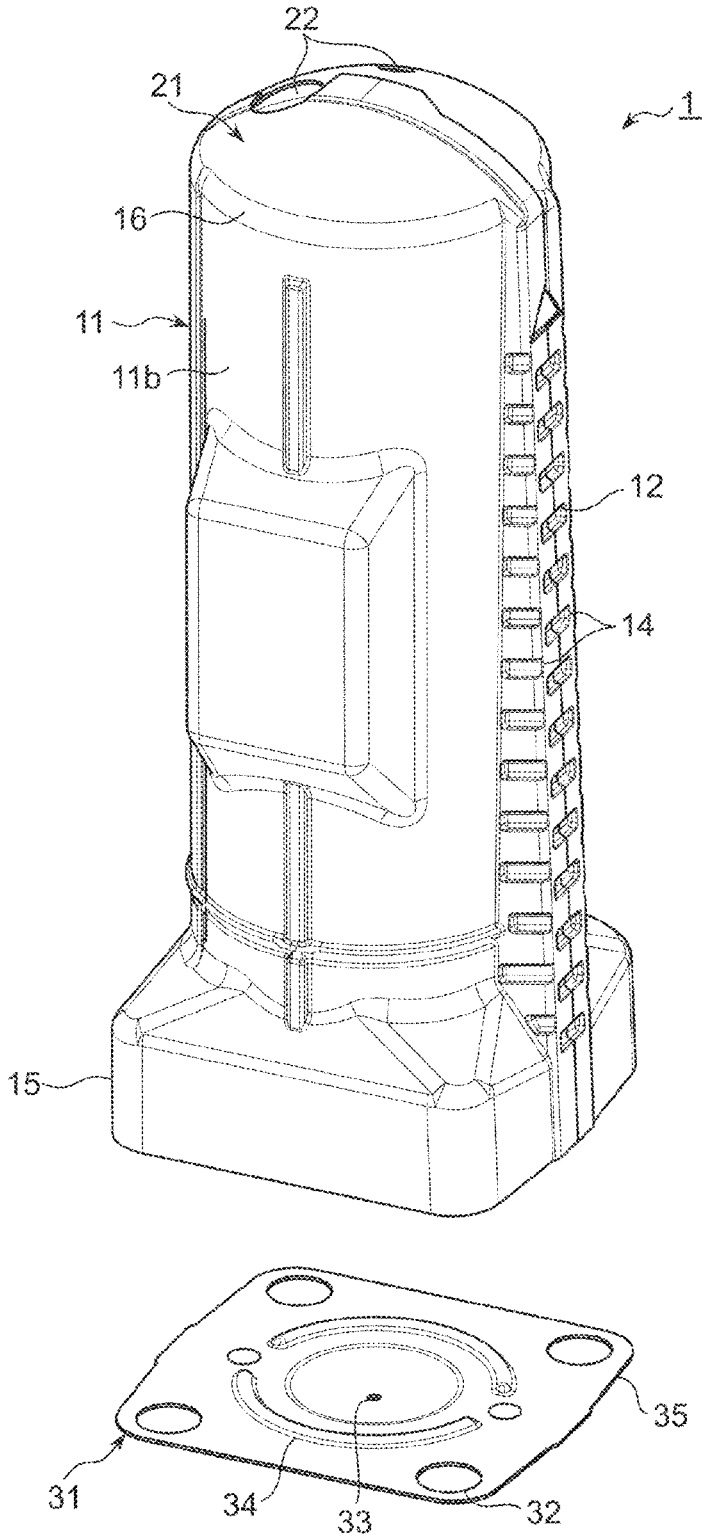
FIG. 1 is an external structure view of a soundproof cover of a compressor for an air conditioner according to the embodiment.

FIG. 1 is an external structure view of a soundproof cover 1 of a compressor for an air conditioner according to the embodiment.

Figure 2:
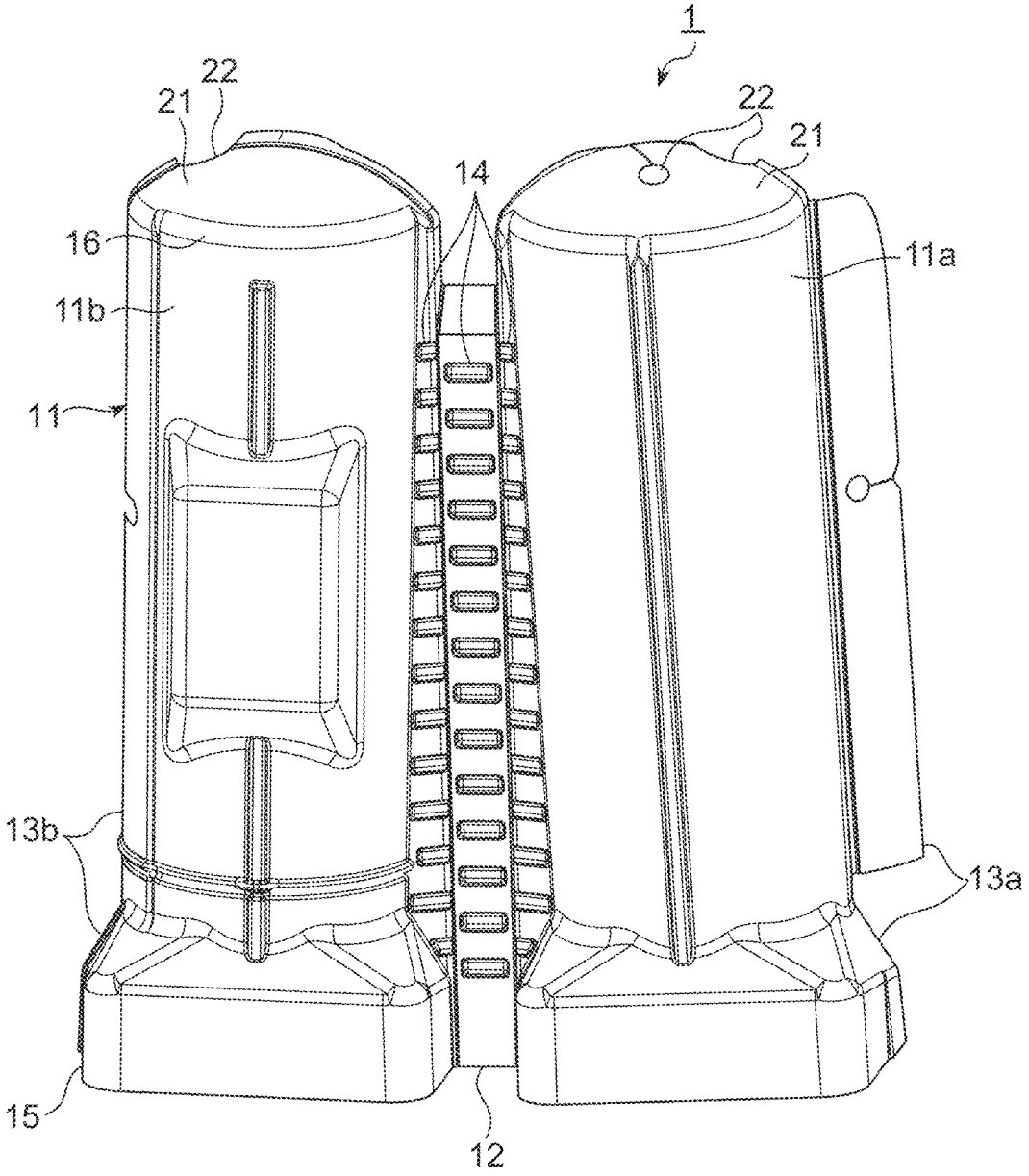
FIG. 2 is an external structure view in a case where the soundproof cover of FIG. 1 is expanded.

FIG. 2 is an external structure view in a case where the soundproof cover 1 of FIG. 1 is expanded.

Figure 3:
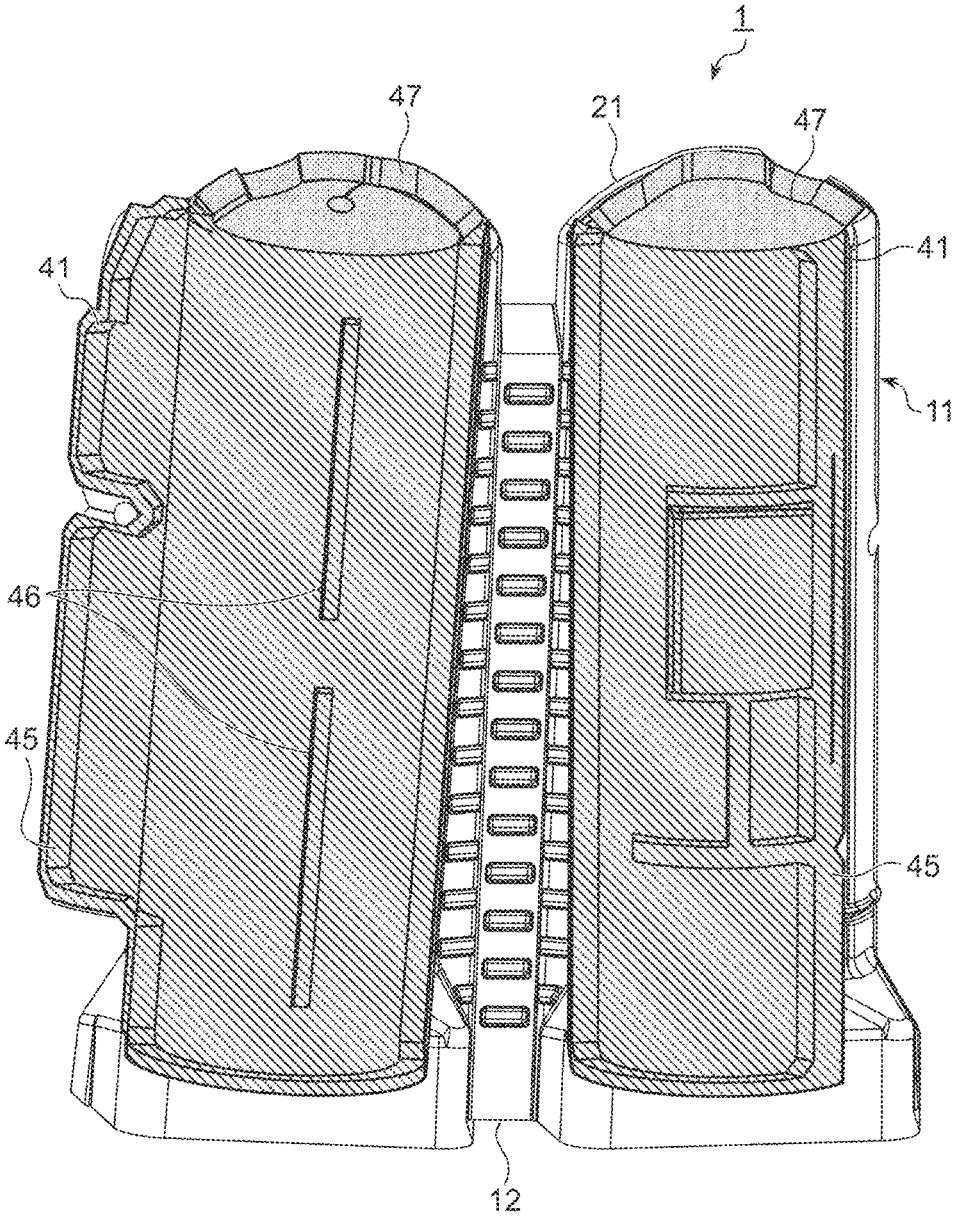
FIG. 3 is a structure view of an inner side in the case where the soundproof cover of FIG. 1 is expanded.

FIG. 3 is a structure view of an inner side in the case where the soundproof cover 1 of FIG. 1 is expanded.

Figure 4:
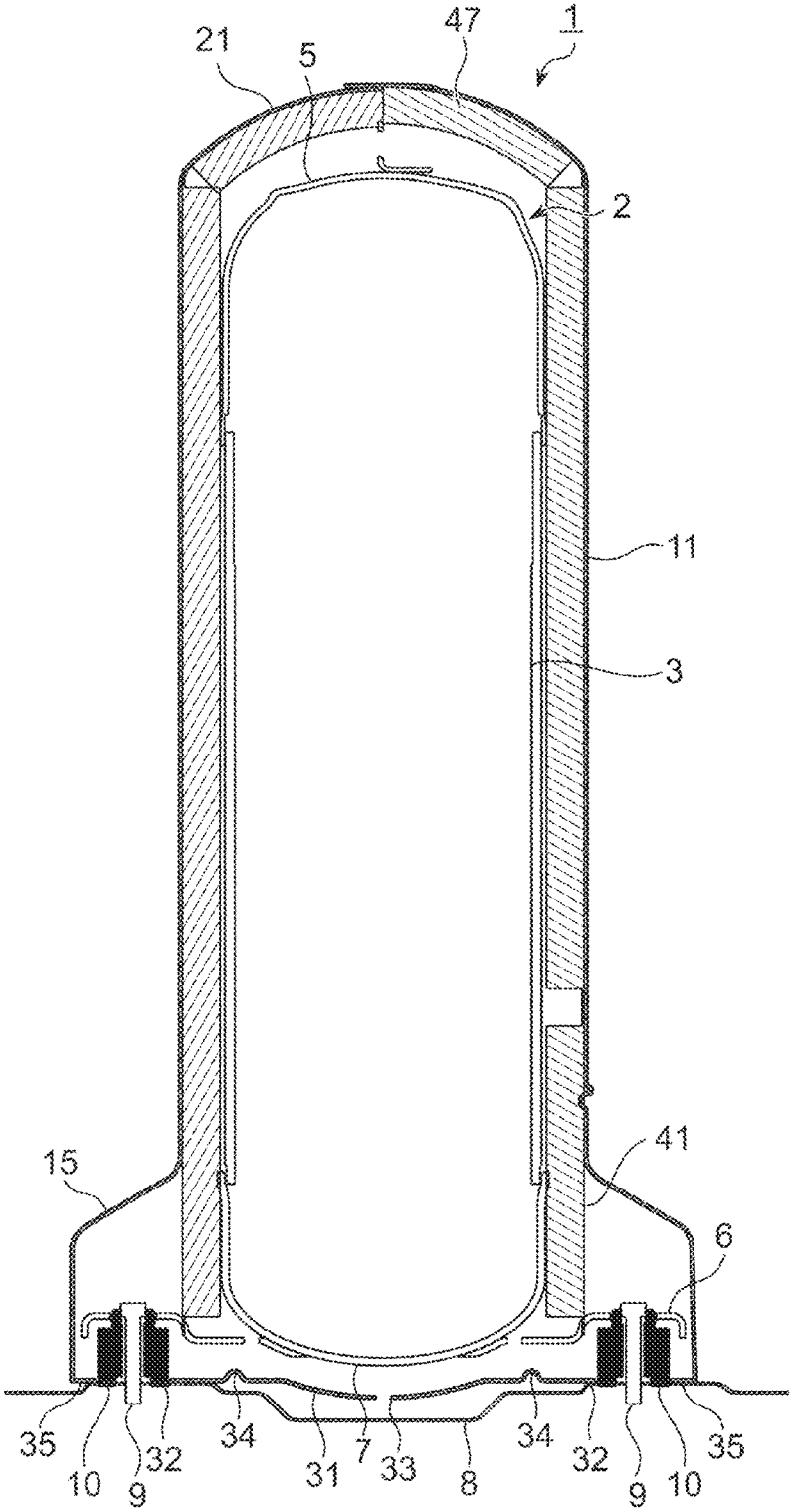
FIG. 4 is a vertical cross-sectional view in a case where the soundproof cover is attached to a compressor.

FIG. 4 is a vertical cross-sectional view in a case where the soundproof cover 1 is attached to a compressor 2.

The soundproof cover 1 of the compressor for the air conditioner according to the present embodiment is used in a state of being attached to the compressor 2 for insulating sound (insulating vibration) for noise (vibration) generated by, for example, the compressor 2 provided in an outdoor unit of an air conditioner.

As shown in FIG. 4, the compressor 2 includes a compressor body portion 3 and a dome-shaped compressor head portion 5 positioned on an upper end side of the compressor body portion 3. The compressor body portion 3 has a compressor leg portion 6 which is a lower end portion of the compressor body portion 3. The compressor leg portion 6 is a base of the compressor 2, which protrudes to the outside from the lower end portion of the compressor body portion 3 as a portion for fixing the compressor 2 with respect to a bottom frame 8 of the outdoor unit on which the compressor 2 is installed. The compressor 2 is fixed to the bottom frame 8 at plural parts (four parts in the present embodiment) by using bolts 9 through the compressor leg portion 6. A rubber cushion 10 is set for the purpose of vibration isolation for the bolts 9, the compressor leg portion 6 and the bottom frame 8.

As shown in FIG. 1, the soundproof cover of the compressor for the air conditioner (soundproof cover) 1 includes a sound-insulating material body portion 11, a sound-insulating material head portion 21, a sound-insulating material bottom portion 31 and a sound absorbing material 41 (see FIG. 3).

The sound-insulating material body portion 11 has a shape corresponding to an outer shape of the compressor body portion 3. That is, the sound-insulating material body portion 11 has a concave-convex shape corresponding to shapes of piping, protrusions and so on provided in the compressor 2. A lower end side 15 of the sound-insulating material body portion 11 has a shape also corresponding to an outer shape of the compressor leg portion 6. That is, the sound-insulating material body portion 11 includes a part corresponding to the compressor leg portion 6. The sound-insulating material body portion 11 has a folded portion 12 extending along a height direction of the soundproof cover 1. The sound-insulating material body portion 11 covers the compressor body portion 3 by being folded through the folded portion 12. Specifically, the sound-insulating material body portion 11 is divided into two members 11*a* and 11*b* (see FIG. 2) at a cut surface extending along the height direction and passing through an approximately central axis of the soundproof cover 1, and the two members 11*a* and 11*b* are connected through the folded portion 12. One member 11*a* of the sound-insulating material body portion 11 is provided with a fixing portion 13*a* overlapping with the other member 11*b* to be fixed to each other when the soundproof cover 1 is attached to the compressor 2. The fixing portion 13*a* is fixed to a fixed portion 13*b* provided in the member 11*b* by a fixing method such as a surface fastener. The fixing portion 13*a* and the fixed portion 13*b* are provided in a region from an upper end side 16 to the lower end side 15 of the sound-insulating material body portion 11. An overlapping part of the member 11*a* and the member 11*b* in the sound-insulating material head portion 21 is also fixed by the surface faster or the like. The folded portion 12 has ribs 14 provided in an approximately perpendicular direction with respect to a folded direction of the folded portion 12. The ribs 14 are provided at plural places at fixed intervals in three rows along the folded direction so that unnecessary distortion does not occur in the vicinity of the folded portion 12 when the soundproof cover 1 is attached to the compressor 2.

As shown in FIG. 1 or FIG. 2, the sound-insulating material head portion 21 has a shape corresponding to an outer shape of the compressor head portion 5. The sound-insulating material head portion 21 is integrally formed with the sound-insulating material body portion 11. That is, the sound-insulating material head portion 21 is formed continuously from the upper end side 16 of the sound-insulating material body portion 11. The sound-insulating material head portion 21 is provided with a piping through hole 22 through which the piping provided in the compressor head portion 5 penetrates.

The sound-insulating material bottom portion 31 has a shape for covering the compressor leg portion 6 (compressor 2) from below (from the bottom part of the compressor 2). Specifically, the sound-insulating material bottom portion 31 is provided between the compressor leg portion 6 and the bottom frame 8 of the air conditioner as shown in FIG. 4. When the sound-insulating material bottom portion 31 is attached to the compressor 2, the sound-insulating material bottom portion 31 is configured not to contact a compressor bottom portion 7. That is because the sound-insulating material bottom portion 31 may be broken due to vibration of the compressor 2. The sound-insulating material bottom portion 31 is provided with bolt through holes 32 through which the bolts 9 penetrate for fixing the compressor 2 to the bottom frame 8 so as to correspond to the number of bolts 9. The sound-insulating material bottom portion 31 also has a drain hole 33 for draining moisture entering into the soundproof cover 1 to the outside of the soundproof cover 1. The sound-insulating material bottom portion 31 further has reinforcing ribs 34 for increasing strength of the sound-insulating material bottom portion 31. When the sound-insulating material bottom portion 31 is disposed, the sound-insulating material body portion 11 is configured to contact a peripheral edge portion 35 of the sound-insulating material bottom portion 31. That is for reducing an aperture ratio as small as possible for preventing noise generated from the compressor 2 from being leaked to the outside.

The sound-insulating material body portion 11, the sound-insulating material head portion 21 and the sound-insulating material bottom portion 31 (sound-insulating materials 11, 21, 31) are respectively molded products of rubber or thermoplastic elastomer having sound insulating properties. The sound-insulating materials 11, 21, 31 are preferably molded products of polyolefin-based thermoplastic elastomer (Thermo Plastic Olefin, TPO). The sound-insulating material bottom portion 31 may be an iron press-molded product, a flat cut product (flat-shaped cut product which is not molded) and a hot-press molded product of nonwoven fabric and a felt sheet. The sound-insulating materials 11, 21, 31 and the sound absorbing material 41 are separately formed, and the sound-insulating materials 11, 21, 31 are formed of rubber or the thermoplastic elastomer, thereby performing molding sufficiently following the shape of the compressor 2. The sound-insulating materials 11, 21, 31 are preferably have a thickness of 1 to 4 mm. The thickness may be uniform as well as may locally vary.

Figure 5:
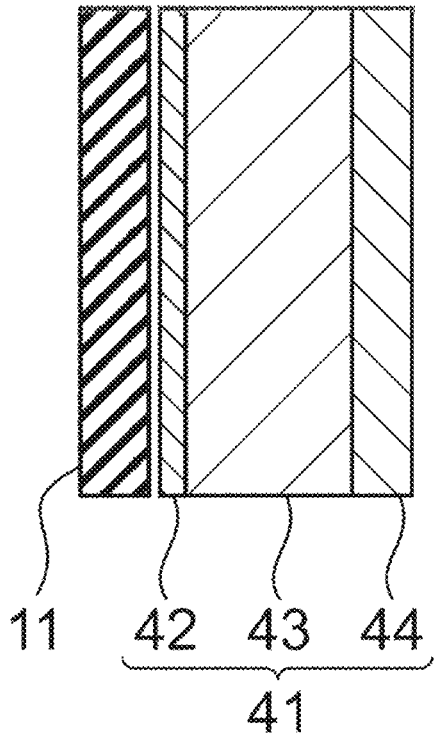
FIG. 5 is a cross-sectional view taken along a thickness direction of the soundproof cover.

The sound absorbing material 41 is provided at least inside the sound-insulating material body portion 11. The sound absorbing material 41 is fixed to the inside of the sound-insulating material body portion 11 by resin fixing pins (so-called tag pins) used when attaching tags (price tags), or fixed by adhesives. FIG. 5 is a cross-sectional view taken along a thickness direction of the soundproof cover 1. In the sound absorbing material 41, a nonwoven fabric sheet 42, a flame-retardant felt sheet 43 and an aluminum sheet 44 are arranged in the order from the sound-insulating material body portion 11.

The flame-retardant felt sheet 43 (felt sheet 43) can use a felt sheet mainly containing natural fibers, chemical fibers (synthetic fibers, regenerated fibers, low-melting point chemical fibers and the like), a felt sheet formed of glass wool, glass fibers formed by a needle punch process or a fiber assembly of laminates of the above, polyurethane foam having open cells (including flexible polyurethane foam and rigid polyurethane foam) and the like. The felt sheet 43 is preferably a resin felt having flame retardant properties.

The nonwoven fabric sheet 42 is nonwoven fabric having appropriate breathability that does not reduce sound absorbency. The nonwoven fabric sheet 42 is formed of, polyester fibers, low-melting point polyester fibers, polypropylene fibers, polyethylene fibers, polyamide fibers, acrylic fibers, urethane fibers, polyvinyl chloride fibers, glass fibers or the like. The nonwoven fabric sheet 42 has flame retardance. The nonwoven fabric sheet 42 may have necessary flame retardance by being applied and impregnated with organic flame retardant materials (bromine compounds, phosphorus compounds, chlorine compounds), inorganic flame retardant materials (antimony compounds, metal hydroxide) and a flame retardant material disclosed in JP-A-2006-83505. The flame retardance is given by applying and impregnating the nonwoven fabric with, for example, a thermosetting resorcinol-based resin formed of monohydric or polyhydric phenol or the like to be thermoset. The flame retardance may be given by allowing the nonwoven fabric to contain flame retardant fibers.

The nonwoven fabric sheet 42 contains the thermosetting resin such as the resorcinol-based resin. Accordingly, the nonwoven fabric sheet 42 is formed into a desired shape by hot-press molding. The nonwoven fabric sheet 42 further has oil repellency and water repellency. The oil repellency and the water repellency are given by further impregnating the nonwoven fabric sheet 42 with a fluorine-based water/oil repellent and the like. Also in the nonwoven fabric sheet 42, at least peripheral edge portions 45 of the nonwoven fabric sheet 42 and the aluminum sheet 44 are bonded together by the above-described thermosetting resin (see FIG. 3). In a case where adhesiveness is not sufficient in the thermosetting resin due to manufacturing conditions and so on, an adhesive such as a hot-melt adhesive is applied. As adhesives, polyethylene, polypropylene, polyolefin-based resin, polyvinyl chloride, polyurethane, polyester, polyamide, phenol resin, epoxy resin and so on can be cited, and the nonwoven fabric is applied and impregnated with a solution containing the above.

As the aluminum sheet 44, for example, an aluminum glass cloth (Aluminum Laminated Glass Cloth, ALGC) which is a sheet in which glass fiber cloth is bonded to an aluminum foil can be used. When ALGC is used, it is possible to prevent the aluminum foil not having elasticity from being broken when the sound absorbing material 41 is press-formed as described later. Moreover, a polyethylene layer is laminated on an inner surface of the aluminum sheet 44 from a viewpoint of heat adhesiveness with respect to the nonwoven fabric sheet 42 at the peripheral edge portions 45. The polyethylene layer is melted when heated, reacting with the resin on the nonwoven fabric cloth 42 side or the hot-melt adhesive, and the nonwoven fabric cloth 42 and the aluminum sheet 44 are bonded. As the aluminum sheet 44, for example, a sheet in which the aluminum foil, the polyethylene layer, the cloth and the polyethylene layer are sequentially laminated can be used.

The sound absorbing material 41 formed of respective members is integrally formed in a state in which the nonwoven fabric sheet 42 and the aluminum sheet 44 cover the felt sheet 43. A length in a circumferential direction of a surface (surface on the aluminum sheet 44 side) arranged on an inner side when the sound absorbing material 41 is installed in the compressor 2 is smaller than a length of a surface (surface on the nonwoven fabric sheet 42 side) arranged on an outer side. Accordingly, it is preferable that the felt sheet 43 is formed of plural pieces of sheets arranged with clearances 46 (see FIG. 3) at prescribed positions for absorbing the difference of the length in the circumferential direction.

The structure of the sound absorbing material 41 according to the embodiment is an example, and is not limited to be above as long as the entire soundproof cover 1 has sound absorbing performance in relation to the sound-insulating materials 11, 21 and 31. It is also preferable that the sound absorbing material is provided with a sound absorbing head portion 47 also on an inner side of the sound-insulating material 21 as shown in FIG. 3. For example, the sound absorbing head portion 47 may be a sound absorbing material formed of only the felt sheet as well as may have the same structure as the above-described sound absorbing material 41.

Next, a method of manufacturing the soundproof cover 1 according to the present embodiment will be explained.

The sound-insulating material body portion 11 and the sound-insulating material head portion 21 which are integrally formed are fabricated by performing vacuum forming and trimming at the same time (simultaneous trimming die vacuum forming) by using the above materials. Alternatively, the sound-insulating material body portion 11 and the sound-insulating material head portion 21 are fabricated by injection molding. The sound-insulating material bottom portion 31 is fabricated by injection molding or press molding using the above materials.

The sound absorbing material 41 is hot-press molded in the state in which the nonwoven fabric sheet 42, the flame-retardant felt sheet 43 and the aluminum sheet 44 are laminated. At this time, the peripheral edge portions 45 are bonded by the thermosetting resin or the hot-melt adhesive contained in the nonwoven fabric sheet 42, the polyethylene layer provided in the aluminum sheet 44 and so on acting on the peripheral edge portions 45. The felt sheet 43 is arranged on an inner side of the thermocompression-bonded peripheral edge portions 45, and the sound absorbing material 41 can be integrally formed immediately. The clearances 46 in the felt sheet 43 are also hot-pressed to thereby bond the aluminum sheet 44 and the nonwoven fabric sheet 42.

When the sound-insulating materials 11, 21, 31 and the sound absorbing material 41 are fabricated as described above, the sound absorbing material 41 is fixed to the sound-insulating materials 11, 21 and 31 by tag pins and so on. Accordingly, the soundproof cover 1 is fabricated.

Next, procedures taken when the soundproof cover 1 is attached to the compressor 2 will be explained. When the compressor 2 is installed on the bottom frame 8, first, the sound-insulating material bottom portion 31 is installed between the compressor leg portion 6 and the bottom frame 8. The sound-insulating material bottom portion 31, the compressor leg portion 6 and the bottom frame 8 are connected and fixed by the bolts 9. Next, the soundproof cover 1 (the sound-insulating material body portion 11 and the sound-insulating material head portion 21 to which the sound absorbing material 41 is fixed) is attached to the compressor 2 along the outer shape of the compressor 2. The soundproof cover 1 is divided into two members 11*a* and 11*b* through the folded portion 12, therefore, the soundproof cover 1 is attached so as to be wound along an outer circumference of the compressor 2. After the positional adjustment of the soundproof cover 1 is completed, the two members 11*a* and 11*b* are fixed through the fixing portion 13*a* and the fixed portion 13*b*. The members 11*a* and 11*b* are coupled by, for example, male and female surface fasteners which are respectively provided in the members 11*a* and 11*b*.

In the soundproof cover 1 according to the embodiment, the molded product having the shape corresponding to the outer shape of the compressor 2 is arranged on the outermost layer, thereby realizing the soundproof cover 1 having an aperture ratio as small as possible. That is, the sound-insulating materials 11, 21 and 31 having the shape corresponding to the outer shape of the compressor 2 on the outer side, and the sound absorbing material 41 having the appropriate thickness is arranged on the inner side thereof. Accordingly, a sealing structure of the soundproof cover 1 and the compressor 2 is formed and the aperture ratio can be reduced. The integrated sound-insulating materials 11 and 21 can further contribute to the reduction in aperture ratio. It is thus possible to absorb and attenuate noise generated from the compressor 2 inside the soundproof cover 1 and sound can be insulated efficiently.

Furthermore, as the sound-insulating material body portion 11 and the sound-insulating material head portion 21 are integrally formed, installation can be made at a time and man-hours can be reduced. At the time of installation, the molded product is attached so as to be wound along the compressor 2, which differs from a related-art molded product (for example, refer to Patent Literature 1) which is attached by being covered from the top of the compressor 2. Accordingly, the soundproof cover 1 according to the embodiment does not require space above the compressor 2, and can be easily attached as long as necessary space is secured around a side surface of the compressor 2.

As the soundproof cover 1 is formed of a material having flexibility such as rubber or thermoplastic elastomer, it is not necessary to carry the soundproof cover in a state of being attached to the compressor 2, namely, in a state of a cylindrical shape as in the related-art molded product, and can be folded and stacked when being carried according to need. Moreover, overlapping portions can be omitted as compared with the case where the sound-insulating material body portion 11 and the sound-insulating material head portion 21 are formed as different members, which can also reduce the usage of materials.

Furthermore, the soundproof cover 1 disposes the peripheral edge portion 35 of the sound-insulating material bottom portion 31 so as to contact the sound-insulating material body portion 11 to improve a sealing degree, which can also reduce the possibility of sound leakage from a lower side of the soundproof cover 1. As the sound-insulating materials 11, 21 and 31 in the outermost layer are formed of the material having flexibility, solid-borne sound due to the interference with peripheral parts can be reduced. As a result, another cushioning material for the solid-borne sound with respect to the peripheral parts is not necessary.

The flexibility of the soundproof cover 1 can improve workability regardless of the position of piping connected to the compressor 2. That is, the related-art molded product to be attached by being covered from the top of the compressor 2 is used for only the compressor of which the piping is extended from above. On the other hand, the soundproof cover 1 according to the present embodiment can perform work such as maintenance of the compressor 2, for example, in a state where only the lower end side 15 is fixed by the fixing portion 13*a* and the fixed portion 13*b* and only an upper part is opened.

A reinforcing plate may be further added between the compressor 2 and the bottom frame 8 for the purpose of reinforcing the bottom frame 8 to which the weight of the compressor 2 is added. In this case, the reinforcing plate may be omitted when the sound-insulating material bottom portion 31 doubles as the function of the reinforcing plate as a first modification example of the soundproof cover 1 according to the present embodiment.

Figure 6:
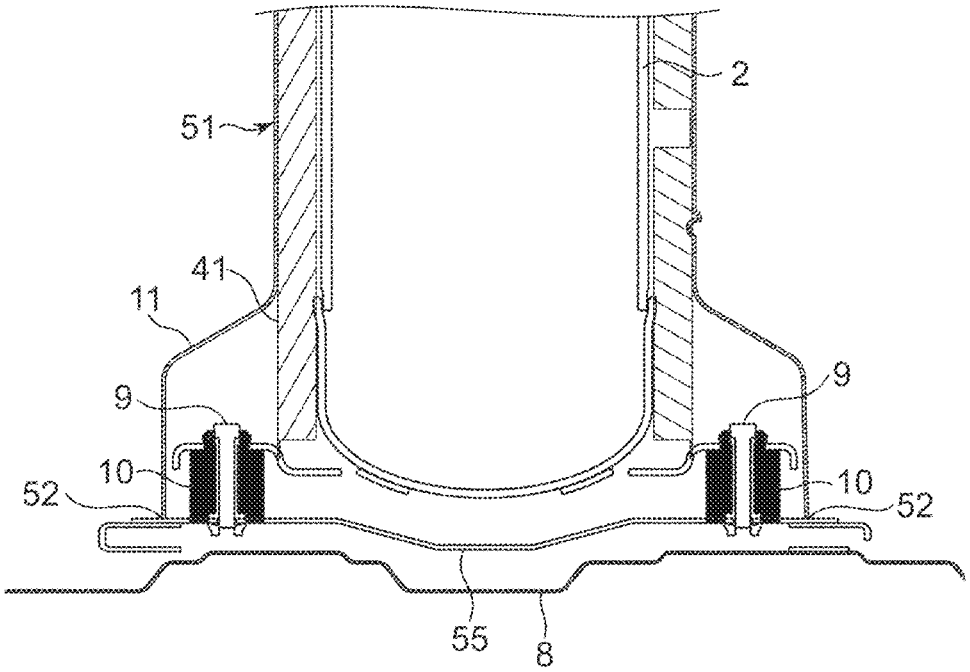
FIG. 6 is a cross-sectional view showing a first modification example of the soundproof cover according to the embodiment.

FIG. 6 is a cross-sectional view showing the first modification example of the soundproof cover 1 according to the present embodiment. In the first modification example, a sound-insulating material bottom portion 55 doubles as a function of a sheet metal as the reinforcing plate. The sound-insulating material body portion 11 has a lower end 52 having a shape that contacts the sound-insulating material bottom portion 55. That is, when the lower end 52 contacts the sound-insulating material bottom portion 55, the sealing degree of a soundproof cover 51 can be maintained in the same manner even when the sound-insulating material bottom portion 55 doubles as the function of the reinforcing plate. In this case, a soundproof sheet having soundproof properties such as a felt sheet may be further arranged on the sound-insulating material bottom portion 55. Accordingly, the soundproofing performance can be further improved. The sound-insulating material bottom portion 55 may be omitted. In such case, the sealing degree can be maintained by allowing the bottom frame 8 to contact the lower end 52.

Figure 7:
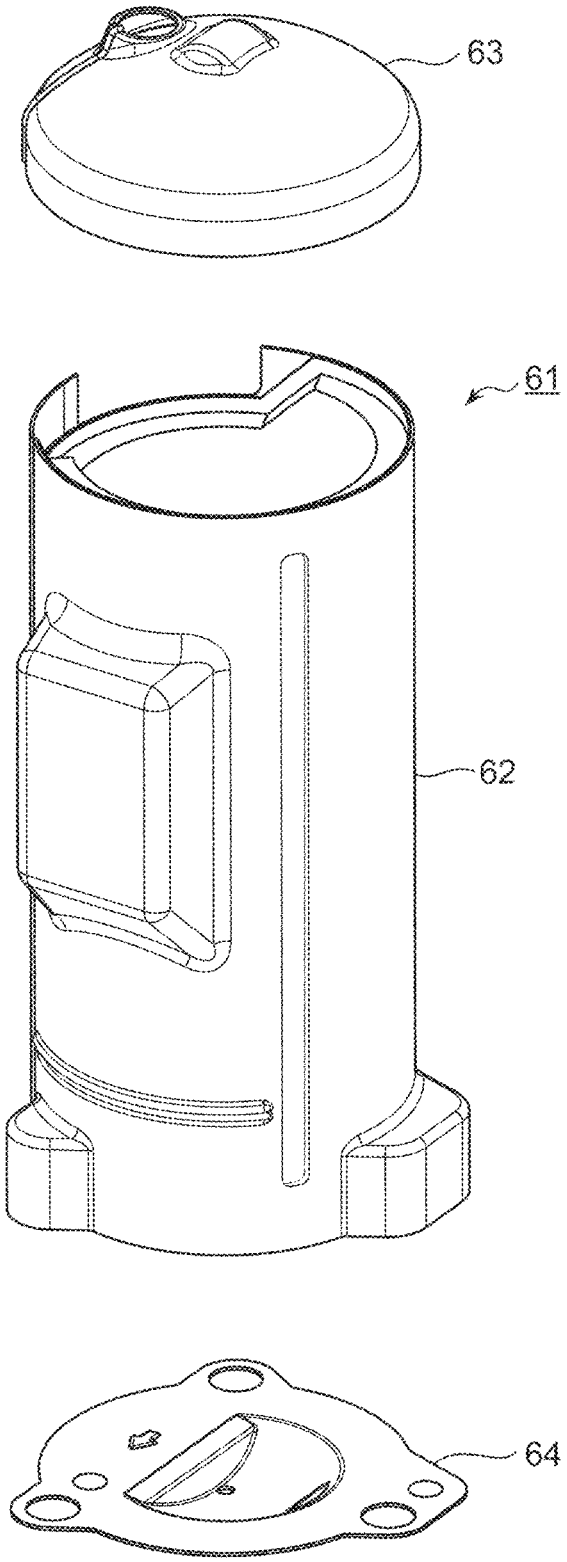
FIG. 7 is an external perspective view showing a second modification example of the soundproof cover according to the embodiment.
Figure 8:
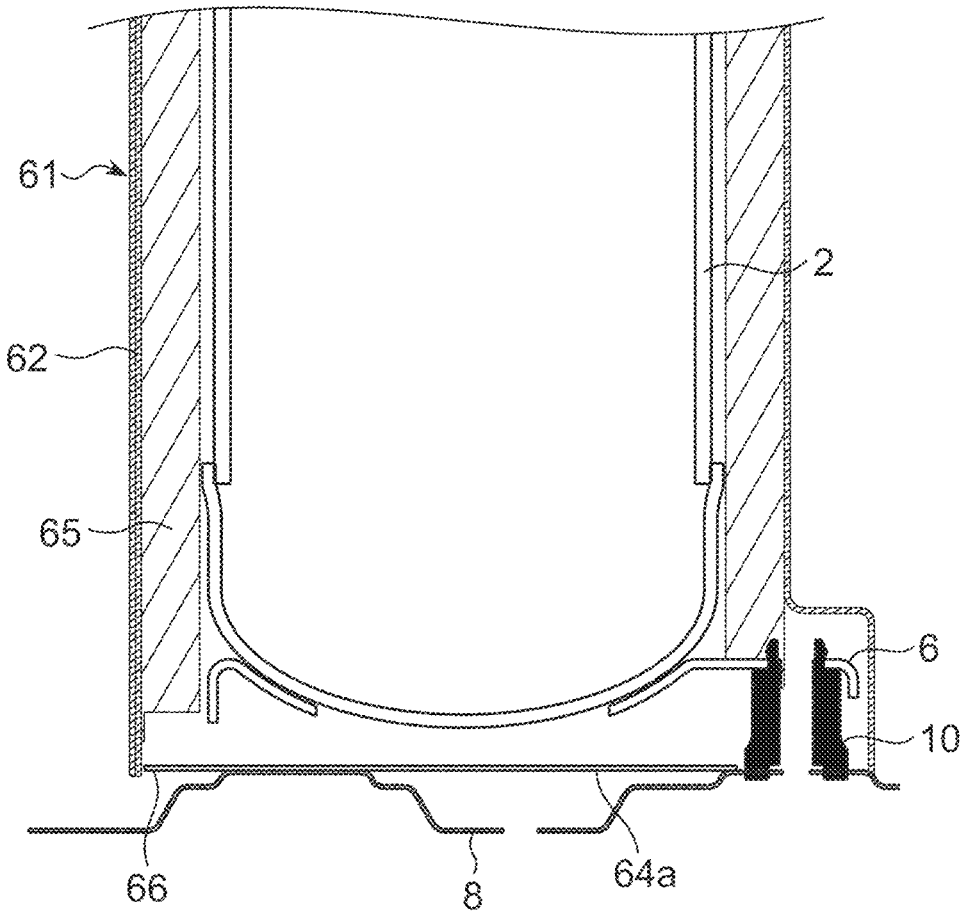
FIG. 8 is a cross-sectional view of the second modification example obtained when a sound-insulating material bottom portion is a sheet metal.

Furthermore, as a second modification example of the soundproof cover 1 according to the present embodiment, the sound-insulating material body portion 11 and the sound-insulating material head portion 21 are formed separately. FIG. 7 is an external perspective view showing a second modification example of the soundproof cover 1 according to the present embodiment. FIG. 8 is a cross-sectional view of the second modification example obtained when the sound-insulating material bottom portion is a sheet metal.

In a soundproof cover 61, a sound-insulating material body portion 62, a sound-insulating material head portion 63 and a sound-insulating material bottom portion (not shown in FIG. 7) are respectively provided as separate components. The sound-insulating material head portion 63 has an overlapping portion with respect to the sound-insulating material body portion 62, which is fixed to the sound-insulating material body portion 62 in the overlapping portion by a surface fastener and the like. The soundproof cover 61 also has a sound absorbing material 65 (see FIG. 8) at least inside the sound-insulating material body portion 62. Also in the soundproof cover 61, a soundproof cover with a high sealing degree (with a small aperture ratio) can be realized in the same manner as the above-described soundproof cover 1. In a case where the sound-insulating material bottom portion is formed of a sheet metal of iron, a flat-shaped sound-insulating material bottom portion 64*a* can be used as shown in FIG. 8. Also in this case, the sound-insulating material body portion 62 contacts a peripheral edge portion 66 of the sound-insulating material bottom portion 64*a*. As other structures of the soundproof cover 61 are almost the same as the soundproof cover 1, the detailed explanation is omitted.

Furthermore, as a third modification example of the soundproof cover 1 according to the present embodiment, it is also preferable that the sound-insulating material body portion 11 and the sound absorbing material 41 are divided in the middle between the upper end and the lower end of the sound-insulating material body portion 11 and partially fixed to the compressor 2.

Figure 9:
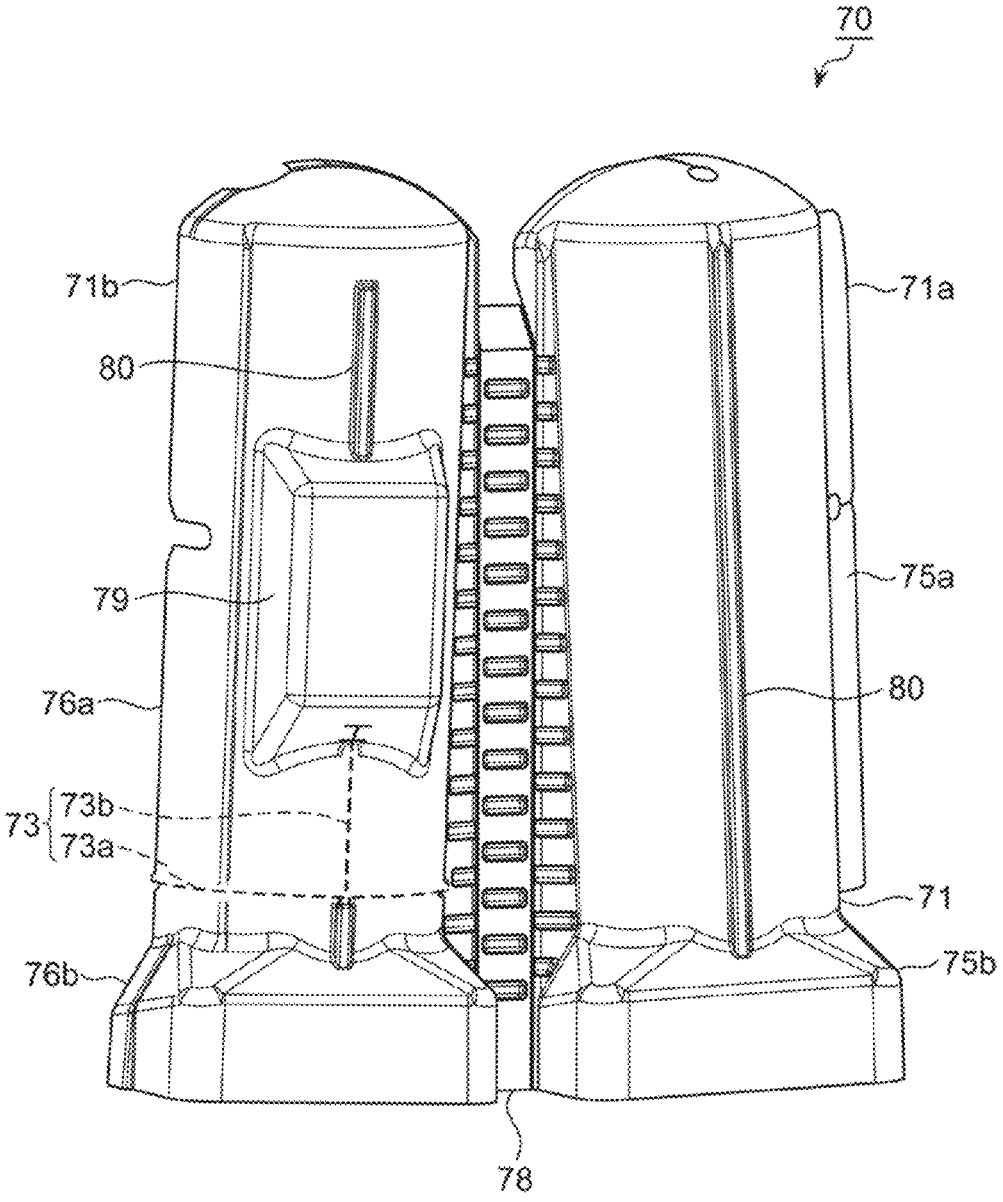
FIG. 9 is an external structure view showing a third modification example of the soundproof cover according to the embodiment.

FIG. 9 is an external structure view showing the third modification example of the soundproof cover 1 according to the present embodiment.

Figure 10:
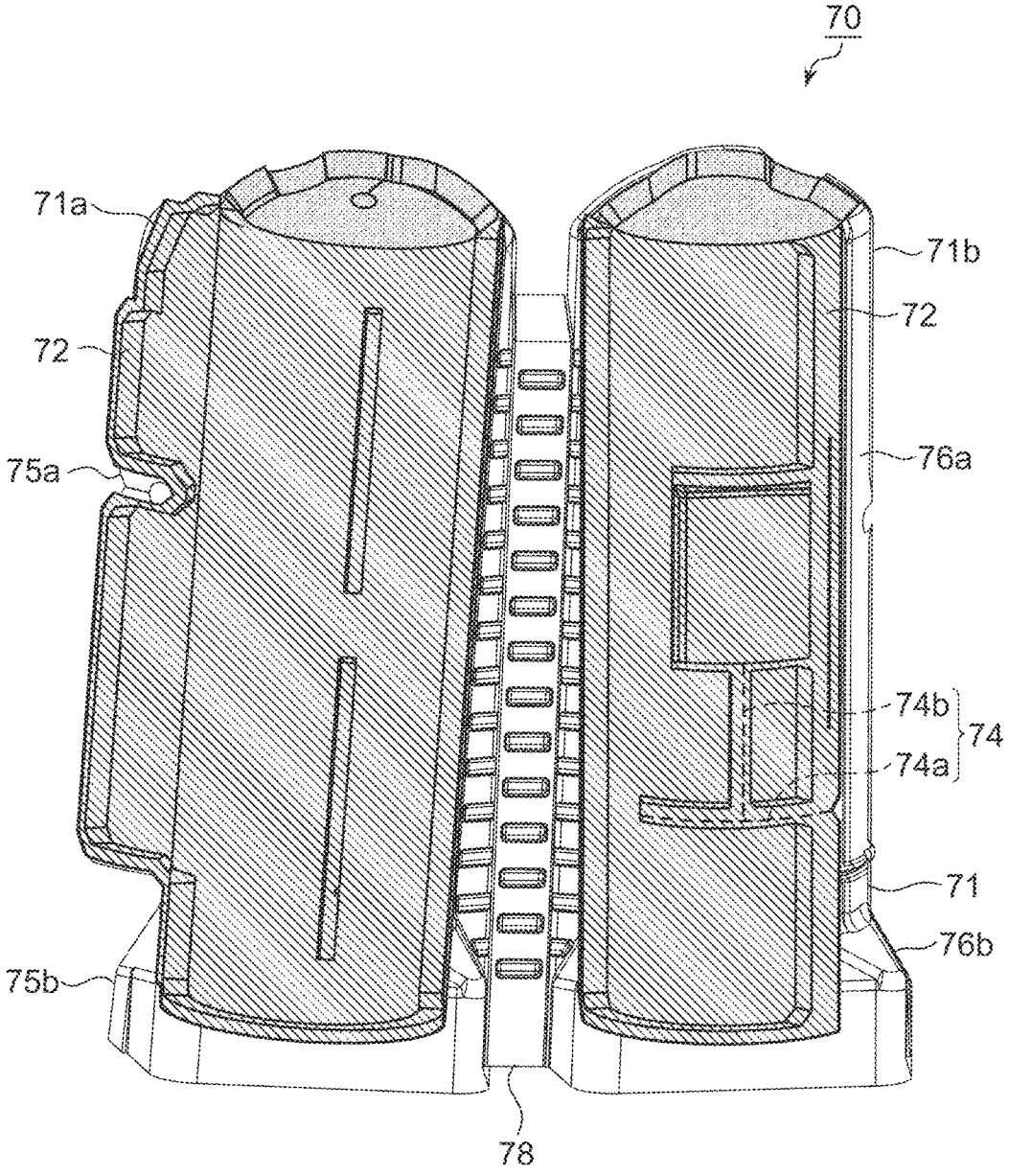
FIG. 10 is a structure view showing the inside of a soundproof cover of FIG. 9.

FIG. 10 is a structure view showing the inside of a soundproof cover 70 of FIG. 9.

Figure 11:
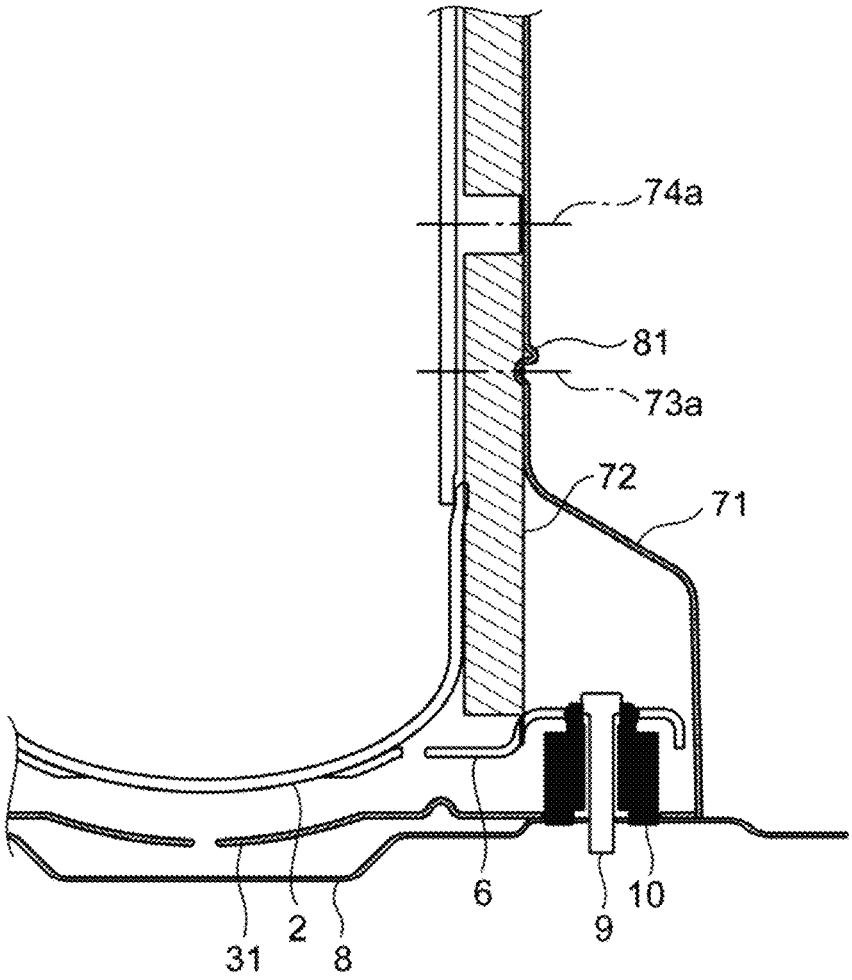
FIG. 11 is a cross-sectional view obtained by enlarging a slit portion of the soundproof cover.

FIG. 11 is a partial cross-sectional view obtained by enlarging a slit portion of the soundproof cover 70. A long and short dashed line 73*a* in FIG. 11 shows a position of a slit 73*a*. A long and short dashed line 74*a* shows a position of a slit 74*a*.

The same symbols are given to components and portions corresponding to the embodiment, and repeated explanation is omitted.

The soundproof cover 70 as the third modification example has slits 73 and 74 in a sound-insulating material body portion 71 and a sound absorbing material 72. In FIG. 9 and FIG. 10, the slits 73 and 74 are shown by dotted lines for convenience of explanation.

The slit 73 (sound-insulating material slit) of the sound-insulating material body portion 71 is provided in the vicinity of an interface in the height direction between a fixing portion 75*a* and a fixed portion 76*a* and a fixing portion 75*b* and a fixed portion 76*b* for fixing members 71*a* and 71*b* at the time of attachment. In FIG. 9, the slit 73 includes the slit 73*a* extending along a circumferential direction of the member 71*b* in which the fixed portions 76*a* and 76*b* are provided and a slit 73*b* extending in an orthogonal direction from the slit 73*a* to a convex portion 79 corresponding to a terminal box of the compressor 2. One end of the slit 73*a* is positioned on an end portion (above the fixed portion 76*a*) in a circumferential direction of the member 71*b*. The other end of the slit 73*a* is positioned on this side of a folded portion 78.

The slit 74 (sound absorbing material slit) of the sound absorbing material 72 is provided at a position different from the slit 73 of the sound-insulating material body portion 71 in the height direction. In FIG. 10, the slit 74 is provided at a higher position than the slit 73. The slit 74 has a slit 74*a* extending along a circumferential direction of the sound absorbing material 72 disposed inside the member 71*b* and a slit 74*b* extending in an orthogonal direction from the slit 74*a* to a position corresponding to the convex portion 79. One end of the slit 74*a* is positioned in one end portion of the sound absorbing material 72 in the circumferential direction. The other end of the slit 74*a* is positioned on this side in the other end portion of the sound absorbing member 72 in the circumferential direction.

Here, when the slit 73 is provided in the sound-insulating material body portion 71, rigidity is reduced. However, the sound-insulating material body portion 71 has reinforcing ribs 80, therefore, rigidity and self-supporting properties of the soundproof cover 70 can be secured. Moreover, when the slit 73*a* is provided, there are risks that moisture such as rain water enters into the soundproof cover 70 to corrode the felt sheet and so on, which may corrode the compressor 2 and cause electric leak. However, the sound-insulating material body portion 71 is provided with a convex portion 81 along the slit 73*a* above the slit 73*a* as shown in FIG. 11, which can prevent entry of moisture from the slit 73*a*.

The soundproof cover 70 as the third modification example enables partial installation of the soundproof cover 70. That is, only a lower part of the slit 73 of the sound-insulating material body portion 71 for covering the compressor leg portion 6 is fixed by the fixing portion 75*b* and the fixed portion 76*b* and an upper part of the slit 73 can be a state in which the compressor 2 is exposed. Therefore, wiring work in the terminal box and so on can be performed while the soundproof cover 70 is partially attached. For example, this is effective at the time of attaching the soundproof cover 70 and at the time of maintenance of the compressor 2. It is also possible to allow pipes and lines to protrude from the compressor through the slits 73 and 74. Positions of the slits 73 and 74 are preferably determined according to positions of wiring work or the like in the compressor 2. Accordingly, it is also preferable that only the slits extending along the circumferential direction are provided. The slits 73 and 74 may be provided on the member 71*a* side (fixing portions 75*a*, 75*b* side).

Moreover, positions of the slit 73 and the slit 74 are made different in the height direction. Accordingly, leakage of sound from a gap generated when slit positions of the sound-insulating material body portion 71 and the sound absorbing material 72 overlap can be prevented, and soundproofing performance can be increased as high as possible.

EXAMPLES

Next, improvement in soundproofing performance of the soundproof cover of the compressor for the air conditioner according to the present invention will be explained by citing examples. The present invention is not limited to the following examples.

Example 1

Figure 12:
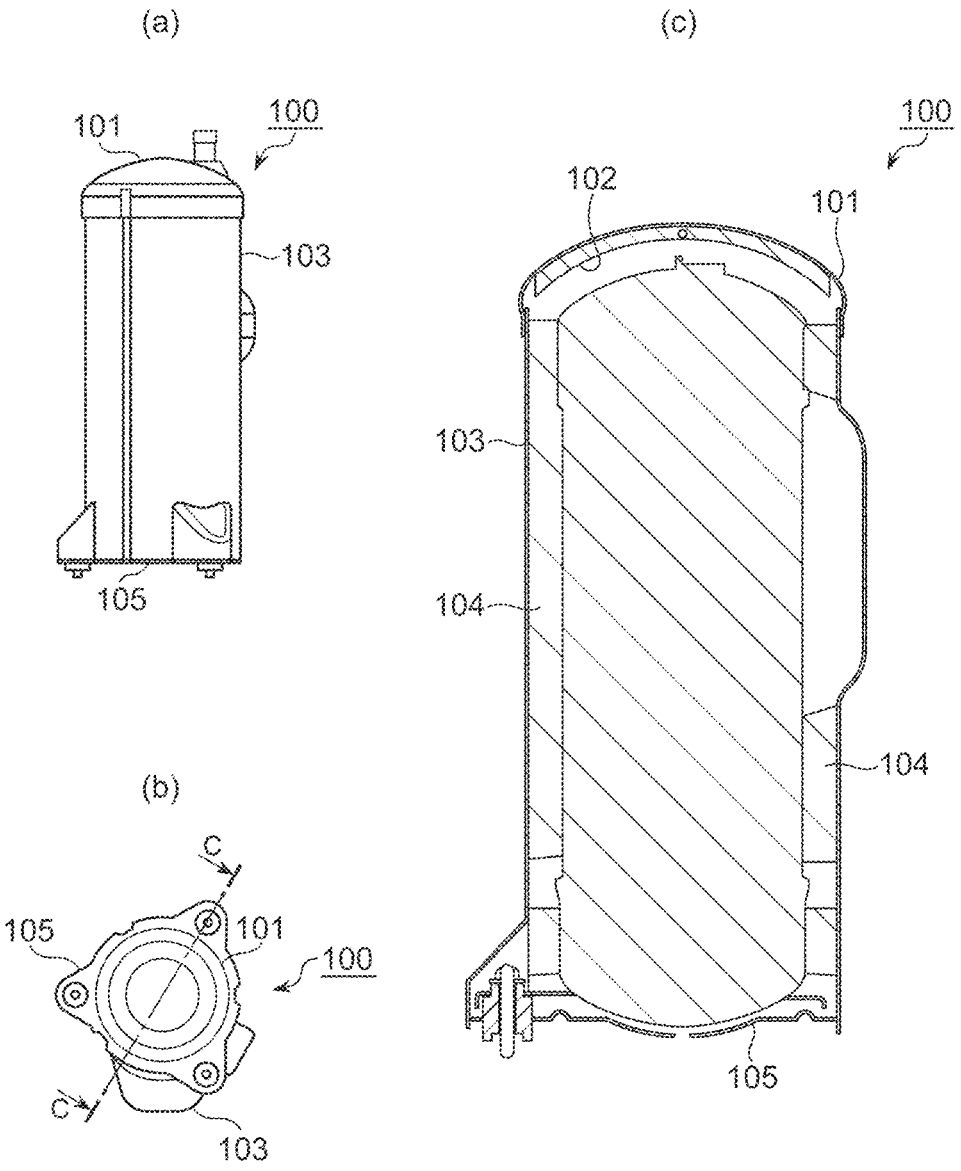
FIG. 12 (*a*) is an external view of a soundproof cover according to Example 1, (b) is a plan view of the soundproof cover of FIGS. 12(*a*) and (*c*) is a cross-sectional view taken along C-C line of FIG. 12(*b*).

FIG. 12(*a*) is an external view of a soundproof cover 100 according to Example 1, (b) is a plan view of the soundproof cover 100 of FIGS. 12(*a*) and (*c*) is a cross-sectional view taken along C-C line of FIG. 12(*b*). The soundproof cover 100 according to Example 1 includes a sound-insulating material head portion 101, a sound-insulating material body portion 103, a sound-insulating material bottom portion 105, a sound-absorbing material head portion 102 and a sound-absorbing material body portion 104. The sound-insulating material head portion 101 and the sound-insulating material body portion 103 are formed of a TPO-based molded product. The sound-insulating material bottom portion 105 is formed by sandwiching a felt sheet by nonwoven fabric sheets from both surfaces and hot-press molded by a metallic mold. The nonwoven fabric sheet is formed of spunbonded nonwoven fabric impregnated with a thermosetting resin. The felt sheet is formed of thermosetting resin felt. The sound-absorbing material head portion 102 is formed of needle felt. The sound-absorbing material body portion 104 is formed by arranging a nonwoven sheet, a felt sheet, an aluminum sheet in the order from the sound-insulating material body portion 103 side. The nonwoven sheet is formed of spunbonded nonwoven fabric impregnated with a thermosetting resin. The felt sheet is formed of thermosetting resin felt. The aluminum sheet is formed of ALGC. Surface weights and thicknesses of respective members are shown in Table 1.

Example 2

A soundproof cover according to Example 2 is the same as the soundproof cover 100 according to Example 1 except that the sound-insulating material bottom portion 105 is not included.

Comparative Example 1

A soundproof cover according to Comparative Example 1 has a sound-insulating material head portion and a sound-absorbing body portion. The sound-insulating material head portion is the same as the sound-insulating material head portion 101 according to Example 1. The sound-absorbing body portion is formed by stacking sound absorbing materials in two layers. One sound absorbing material arranged on an outer side (opposite side of the compressor's side) is a member formed by combining a vinyl chloride sheet, a felt sheet, a vinyl chloride sheet, a felt sheet and an aluminum sheet in the order from the outer side. The other sound absorbing material arranged in an inner side is a member formed by combining a vinyl chloride sheet, a felt sheet and an aluminum sheet in the order from an outer side. The felt sheet is formed of needle felt and the aluminum sheet is formed of aluminum foil. The aluminum sheet and the felt sheet are bonded by an adhesive and the like. The vinyl chloride sheet and the felt sheet are fixed by tag pins. Surface weights and thicknesses of respective members are shown in Table 1.

TABLE 1

| | Portion | | Sound absorbing/insulating layer | Material | Surface weight kg/m$^2$ | Thickness mm |
|---|---|---|---|---|---|---|
| Example 1 | Head portion | | Sound insulating layer | TPO-based molded product | 3.6 | 2 |
| | | | Sound absorbing layer | Needle felt | 1.2 | 20 |
| | | | | subtotal | 4.8 | 22 |
| | Body portion | | Sound insulating layer | TPO-based molded product | 3.6 | 2 |
| | | | Sound absorbing layer | Spunbonded nonwoven fabric | 0,085 | 0.1 |
| | | | | Resin felt | 1 | 20 |
| | | | | ALGC | 0.052 | 0.02 |
| | | | | subtotal | 4.737 | 22.12 |
| | Bottom portion | | Sound insulating (sound absorbing) layer | Spunbonded nonwoven fabric | 0.085 | 0.1 |
| | | | | Resin felt | 1 | 2 |
| | | | | Spunbonded nonwoven fabric | 0.085 | 0.1 |
| | | | | subtotal | 1.17 | 2.2 |
| Example 2 | Head portion | | Sound insulating layer | TPO-based molded product | 3.6 | 2 |
| | | | Sound absorbing layer | Needle felt | 1.2 | 20 |
| | | | | subtotal | 4.8 | 22 |
| | Body portion | | Sound insulating layer | TPO-based molded product | 3.6 | 2 |
| | | | Sound absorbing layer | Spunbonded nonwoven fabric | 0.085 | 0.1 |
| | | | | Resin felt | 1 | 20 |
| | | | | ALGC | 0.052 | 0.02 |
| | | | | subtotal | 4.737 | 22.12 |
| | Bottom portion | | | | | |
| Comparative Example 1 | Head portion | | Sound insulating layer<br>Sound absorbing layer | TPO-based molded product | 3.6 | 2 |
| | | | | subtotal | 3.6 | 2 |
| | Body portion | Outer side | Sound absorbing (sound insulating) layer | PVC | 5 | 2 |
| | | | Sound absorbing layer | Needle felt | 0.8 | 5 |
| | | | | PVC | 2.5 | 1 |
| | | | | Needle felt | 0.8 | 5 |
| | | | | Aluminum foil | 0.135 | 0.05 |
| | | Inner side | Sound absorbing (sound insulating) layer | PVC | 7.8 | 3 |
| | | | Sound absorbing layer | Needle felt | 0.8 | 5 |
| | | | | Aluminum foil | 0.135 | 0.05 |
| | | | | subtotal | 17.97 | 21.1 |
| | Bottom portion | | | | | |

In order to evaluate sound absorbing and sound insulating performance of Examples 1, 2 and Comparative Example 1, a sound excitation test was performed in a fully anechoic chamber (capacity 30 $m^3$, background noise 20 dB (A) or less, cutoff frequency 140 Hz, sound absorbing ratio 98%) The sound excitation test was performed by evaluating differences in sound pressure levels obtained in cases where the soundproof cover is attached and not attached as performances.

Figure 13:
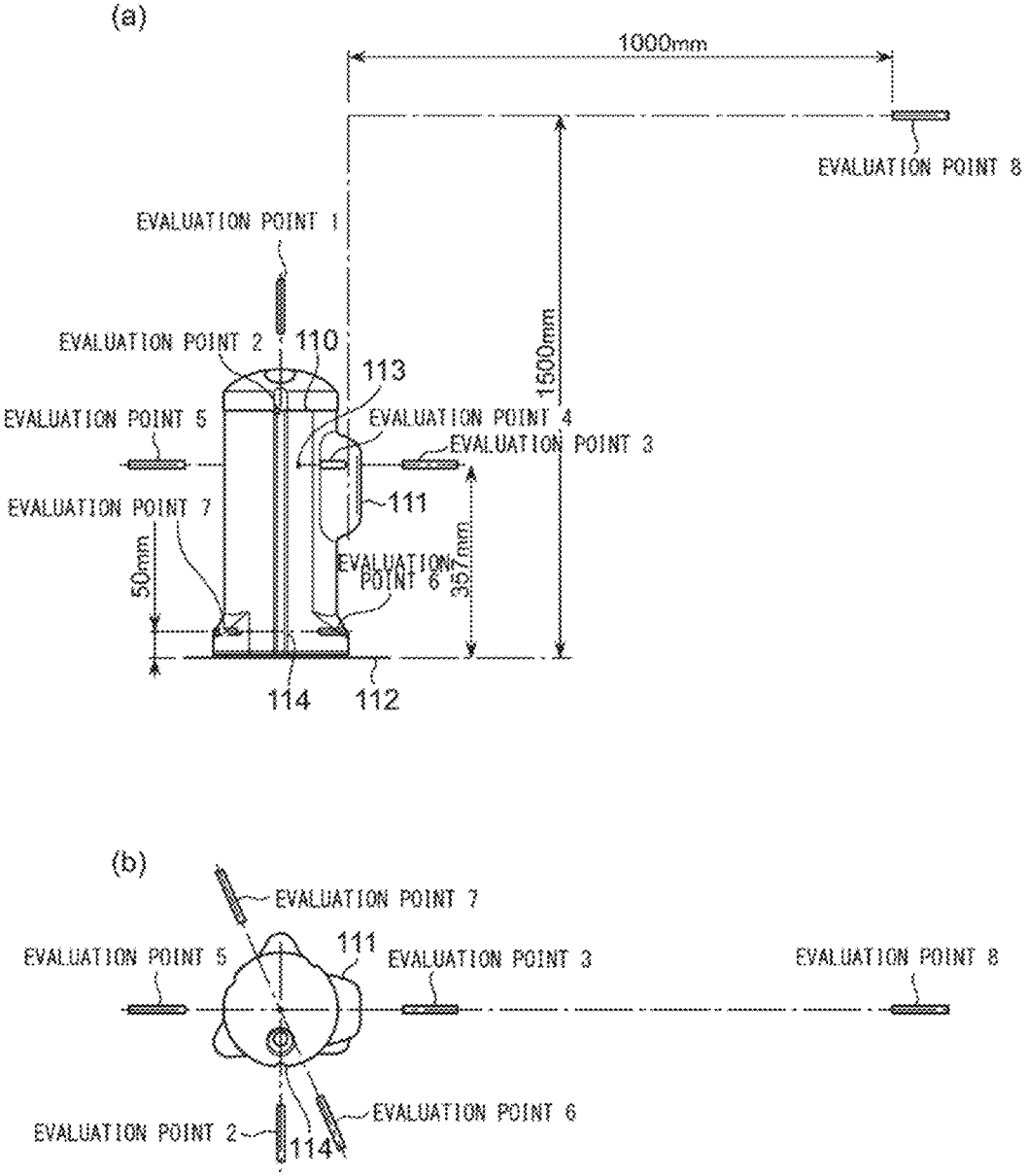
FIG. 13 (*a*) is an external view for explaining evaluation points in sound excitation test and (b) is a plan view of FIG. 13(*a*).
Figure 14:
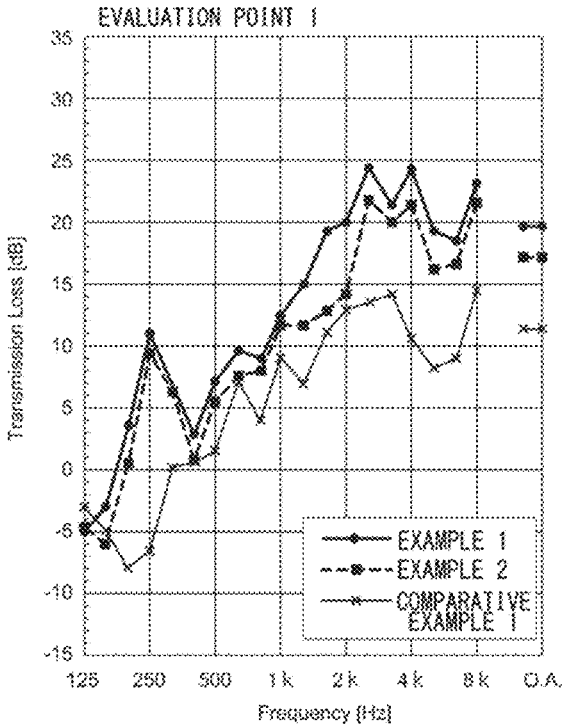
FIG. 14 is a graph indicating differences in sound pressure levels according to the presence of the soundproof cover in an evaluation point 1 according to Example 1, Example 2 and Comparative Example 1.
Figure 15:
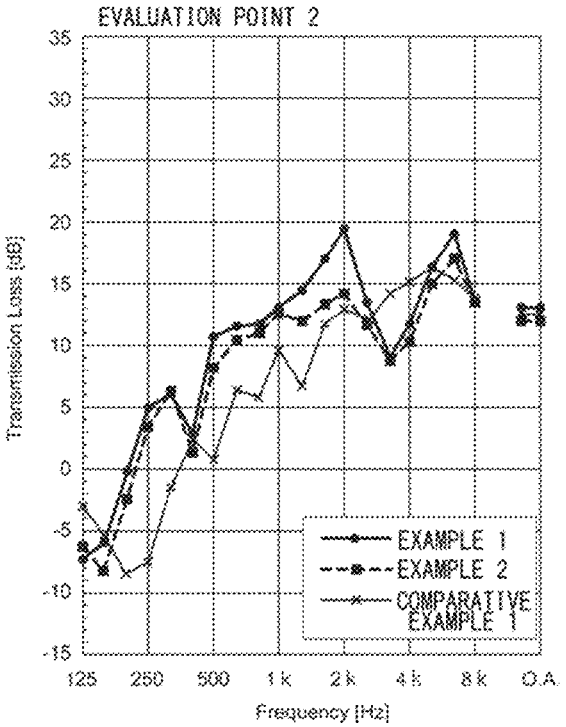
FIG. 15 is a graph indicating differences in sound pressure levels according to the presence of the soundproof cover in an evaluation point 2 according to Example 1, Example 2 and Comparative Example 1.
Figure 16:
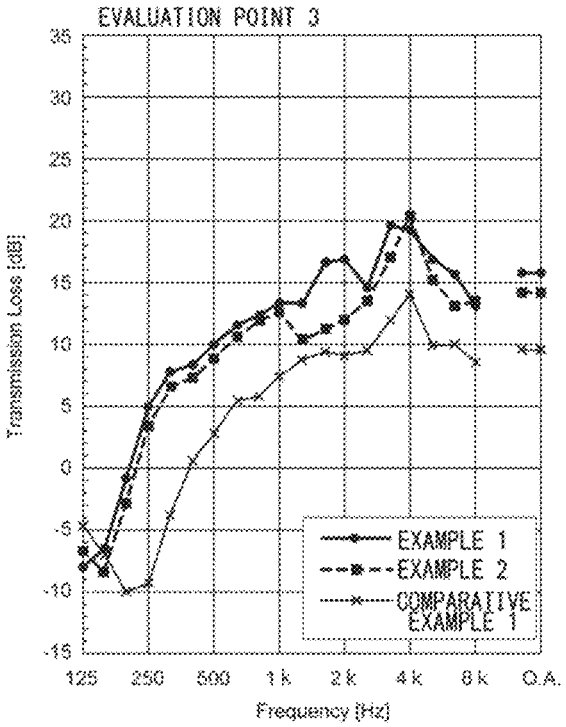
FIG. 16 is a graph indicating differences in sound pressure levels according to the presence of the soundproof cover in an evaluation point 3 according to Example 1, Example 2 and Comparative Example 1.
Figure 17:
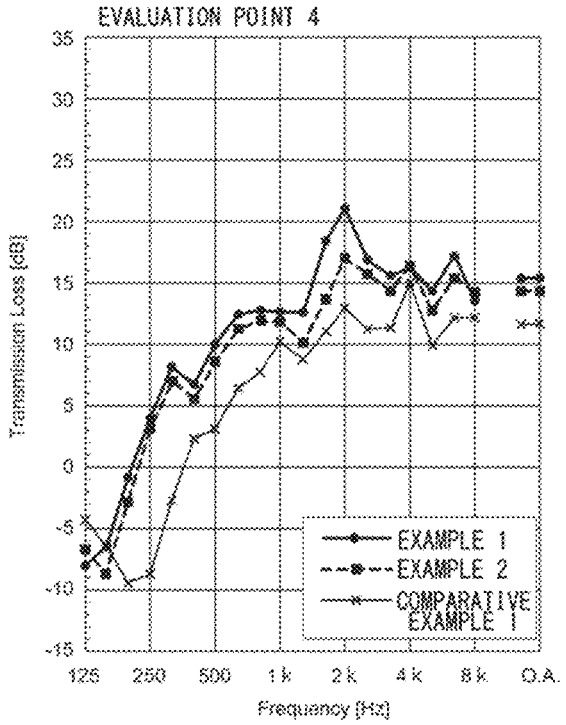
FIG. 17 is a graph indicating differences in sound pressure levels according to the presence of the soundproof cover in an evaluation point 4 according to Example 1, Example 2 and Comparative Example 1.
Figure 18:
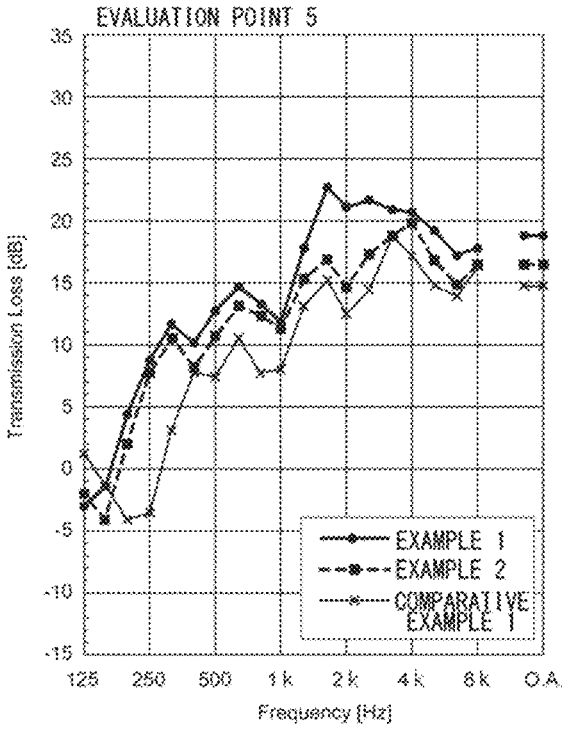
FIG. 18 is a graph indicating differences in sound pressure levels according to the presence of the soundproof cover in an evaluation point 5 according to Example 1, Example 2 and Comparative Example 1.
Figure 19:
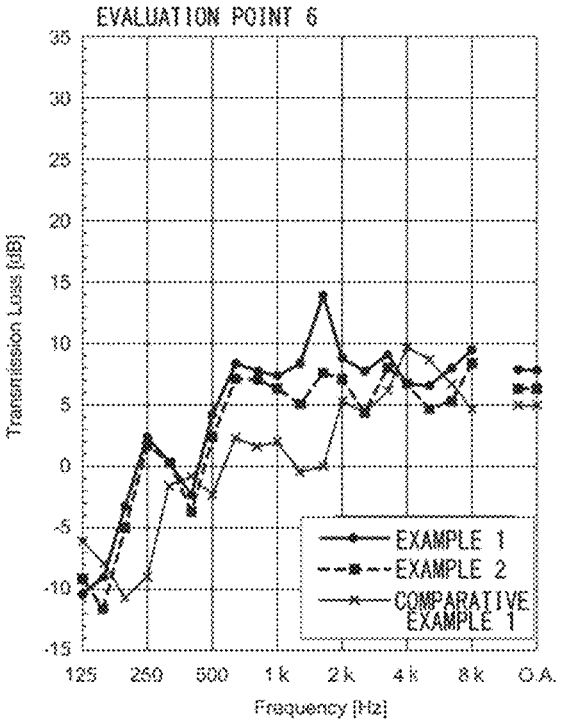
FIG. 19 is a graph indicating differences in sound pressure levels according to the presence of the soundproof cover in an evaluation point 6 according to Example 1, Example 2 and Comparative Example 1.
Figure 20:
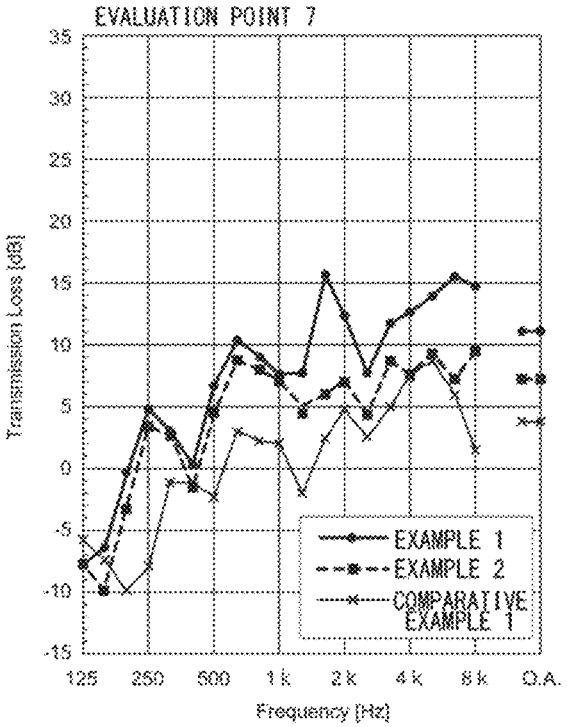
FIG. 20 is a graph indicating differences in sound pressure levels according to the presence of the soundproof cover in an evaluation point 7 according to Example 1, Example 2 and Comparative Example 1.
Figure 21:
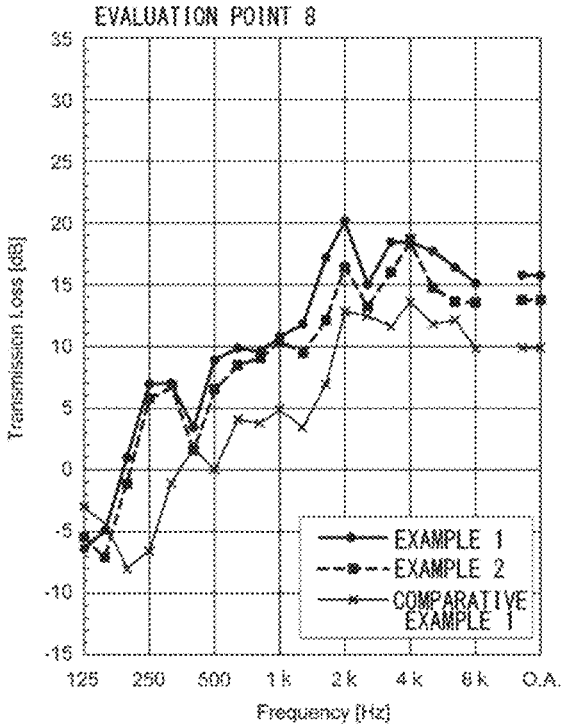
FIG. 21 is a graph indicating differences in sound pressure levels according to the presence of the soundproof cover in an evaluation point 8 according to Example 1, Example 2 and Comparative Example 1.

Specifically, sound excitation was performed by using a jig simulating the compressor by speakers from the inside of the jig. Installing positions of speakers as excitation points were a position of 125 mm in a height direction from an installation surface of the simulated compressor (excitation point 1), a position of 250 mm (excitation point 2) and a position of 375 mm (excitation point 3). Installation position of microphones as evaluation points were, as shown in FIG. 13, a central position above the compressor (soundproof cover) (evaluation point 1), a position of a lower end of a sound-insulating material head portion 110 (evaluation point 2), a position of a terminal box 111 as well as a position of a height 357 mm from a simulated compressor installation surface 112 (evaluation point 3), a discharge piping position 113 (evaluation point 4), a position facing a simulated compressor with respect to the evaluation point 3 (evaluation point 5), a position of a fixing position of the soundproof cover 114 by the surface fastener as well as a position of 50 mm in a height direction from the simulated compressor installation surface 112 (evaluation point 6), a position facing the simulated compressor with respect to the evaluation point 6 (evaluation point 7) and a position of 1000 mm in a direction away from the compressor from an outer edge of the terminal box position 111 as well as a position of 1500 mm in a height direction from the simulated compressor installation surface 112 (evaluation point 8).

Figure 22:
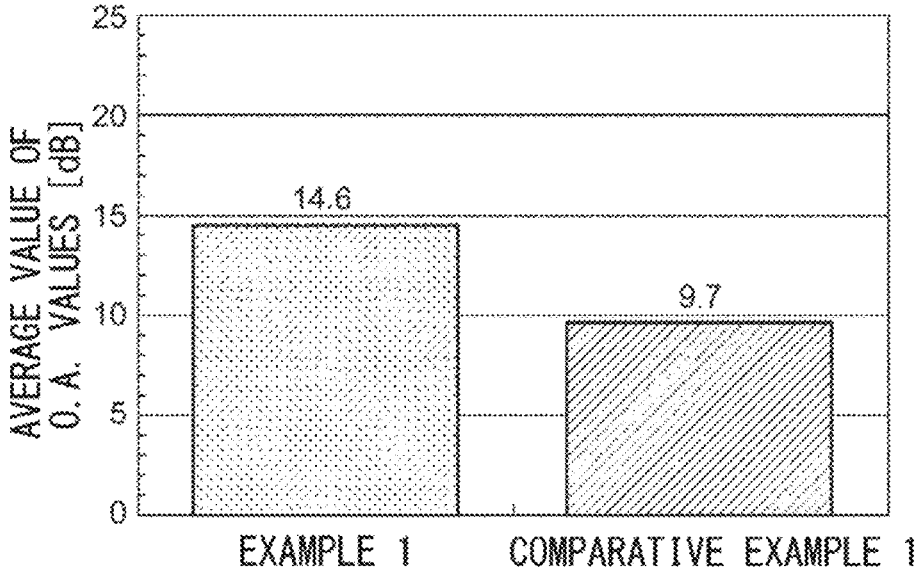
FIG. 22 is a graph in which average values of overall values of transmission loss at respective evaluation points of Example 1 and Comparative Example 1 shown in FIG. 14 to FIG. 21 are compared.
Figure 23:
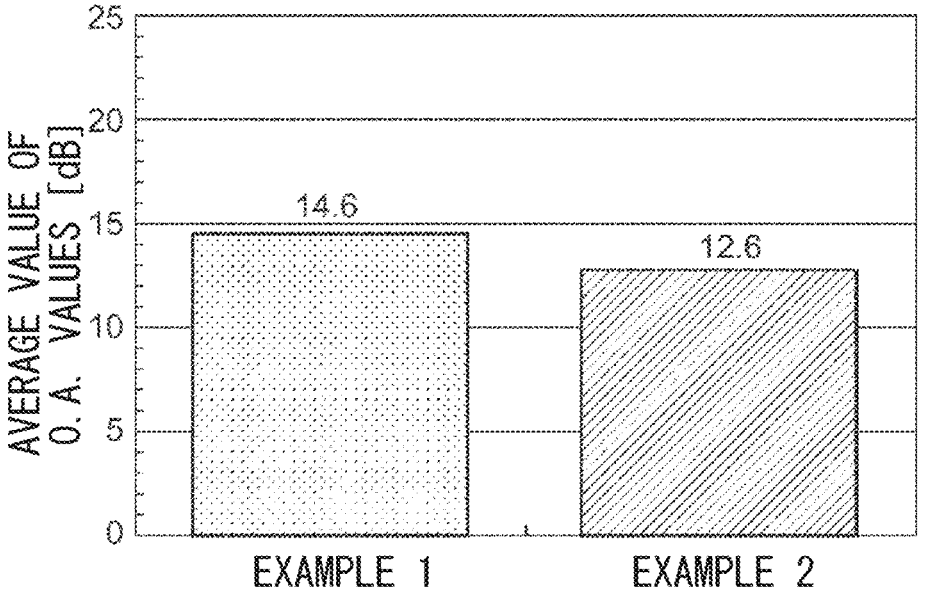
FIG. 23 is a graph in which average values of overall values of transmission loss at respective evaluation points of Example 1 and Example 2 shown in FIG. 14 to FIG. 21 are compared.

Evaluation values are arithmetic mean values in sound pressure levels at respective evaluation points. The above tests were respectively performed in the case where the soundproof cover was not attached and in the case where the soundproof cover was attached, and effects of the soundproof cover were evaluated by differences (transmission loss) of obtained sound pressure levels. FIG. 14 to FIG. 21 are graphs indicating differences in sound pressure levels according to the presence of the soundproof cover in the evaluation points 1 to 8 according to Example 1, Example 2 and Comparative Example 1. In FIG. 14 to FIG. 21, the horizontal axis represents the frequency (Hz) and the vertical axis represents the difference in sound pressure levels according to the presence of the soundproof cover (dB). FIG. 22 is a graph in which average values of overall values (O.A. values) of the transmission loss at respective evaluation points of Example 1 and Comparative Example 1 shown in FIG. 14 to FIG. 21 are compared. FIG. 23 is a graph in which average values of overall values (O.A. values) of the transmission loss at respective evaluation points of Example 1 and Example 2 shown in FIG. 14 to FIG. 21 are compared. In FIG. 14 to FIG. 21, there may be a case where a smaller value than 0 dB is measured depending to a measuring device. Moreover, FIG. 14 to FIG. 23 are graphs indicating the difference in sound pressure levels according to the presence of the soundproof cover as soundproofing effects (that is, to what extent the sound pressure levels are lowered), and the larger numeral values are, the higher the soundproofing effects are.

As shown in FIG. 14 to FIG. 21, evaluation results in Example 1 and Example 2 are higher than evaluation results in Comparative Example 1 in almost all frequency bands, and it is found that soundproofing performance is higher in the Example 1 and Example 2 as compared with Comparative Example 1. In the case where evaluation is performed by O.A. values, improvement of performance by approximately 5 dB was realized in Example 1 as compared with Comparative Example 1. Improvement of performance by 10 dB or more was realized in Example 1 and Example 2 as compared with Comparative Example 1 depending on the frequency band.

In the case where soundproofing performance is compared according to the presence of the sound-insulating material bottom portion by making comparison between Example 1 and Example 2, improvement of performance by approximately 2 dB in O.A. values was realized in Example 1 as compared with Example 2. According to evaluations in respective evaluation points, it is found that improvement of performance particularly in high frequencies of 1 KHz or more is realized by providing the sound-insulating material bottom body in the soundproof cover. This is because soundproofing performance can be largely improved by sealing the compressor bottom portion.

REFERENCE SIGNS LIST

1, 51, 61, 70 soundproof cover of compressor for air conditioner (soundproof cover)
2 compressor
3 compressor body portion
5 compressor head portion
6 compressor leg portion
7 compressor bottom portion
8 bottom frame
11, 62, 71 sound-insulating material body portion
12, 78 folded portion
14 rib
21, 63 sound-insulating head portion
31, 55, 64*a* sound-insulating bottom portion
35, 66 peripheral edge portion
41, 65, 72 sound absorbing material
42 nonwoven fabric sheet
43 flame-retardant felt sheet
44 aluminum sheet
73, 74 slit
81 convex portion

The invention claimed is:

1. A soundproof cover of a compressor for an air conditioner comprising:

a sound-insulating material body portion, that is a rubber or thermoplastic-elastomer molded product with sound-insulating properties, having a shape corresponding to an outer shape of a compressor body portion and a compressor leg portion, wherein the sound-insulating material body portion has two members connected by a folded portion extending in a first direction, wherein the sound-insulating material body portion covers the compressor body portion by being folded through the folded portion;

a sound-insulating material head portion, that is a rubber or thermoplastic-elastomer molded product with sound-insulating properties, having a shape corresponding to an outer shape of a compressor head portion positioned on a first side of the compressor body portion; and a sound absorbing material provided at least inside the sound-insulating material body portion, wherein the folded portion includes a central portion having a first side extending in the first direction, having a second side extending in the first direction, and being disposed between and movably fixed to a first member of the two members and a second member of the two members, the first member extends in the first direction on the first side of the central portion, and is movably fixed to the first side of the central portion, the second member extends in the first direction on the second side of the central portion, and is movably fixed to the second side of the central portion, the first side being opposite to the second side.

2. The soundproof cover of the compressor for the air conditioner according to claim 1, wherein the sound-insulating material body portion and the sound-insulating material head portion are integrally molded.

3. The soundproof cover of the compressor for the air conditioner according to claim 1, further comprising:

a sound-insulating material bottom portion having a shape for covering the compressor leg portion positioned on a second side of the compressor body portion.

4. The soundproof cover of the compressor for the air conditioner according to claim 3, wherein the sound-insulating material body portion contacts a peripheral edge portion of the sound-insulating material bottom portion.

5. The soundproof cover of the compressor for the air conditioner according to claim 3, wherein the sound-insulating material bottom portion is a reinforcing plate for reinforcing a bottom frame on which the compressor is installed.

6. The soundproof cover of the compressor for the air conditioner according to claim 5, wherein the sound-insulating material body portion has a shape contacting the bottom frame or the reinforcing plate.

7. The soundproof cover of the compressor for the air conditioner according to claim 1, wherein the folded portion has ribs provided in an approximately perpendicular direction with respect to the first direction.

8. The soundproof cover of the compressor for the air conditioner according to claim 1, wherein the sound absorbing material is formed by arranging a nonwoven fabric sheet, a flame-retardant felt sheet and an aluminum sheet in order from the sound-insulating material body portion's side.

9. The soundproof cover of the compressor for the air conditioner according to claim 1, wherein the sound-insulating material body portion has a sound-insulating material slit extending along a circumferential direction of the compressor.

10. The soundproof cover of the compressor for the air conditioner according to claim 9, wherein the sound absorbing material has a sound-absorbing material slit extending along the circumferential direction of the compressor at a position different from the sound-insulating material slit in a height direction.

11. The soundproof cover of the compressor for the air conditioner according to claim 9, wherein sound-insulating material body portion has a convex portion extending along the sound-insulating material slit on an upper part of the sound-insulating material slit.

* * * * *